United States Patent [19]

Focke et al.

[11] 4,100,718

[45] Jul. 18, 1978

[54] MEANS FOR THE PRODUCTION AND FILLING OF A PARALLELEPIPEDIC PACKET

[75] Inventors: Heinz Focke, Verden; Hans-Jürgen Bretthauer, Bremen, both of Fed. Rep. of Germany

[73] Assignee: Focke & Pfuhl, Verden, Fed. Rep. of Germany

[21] Appl. No.: 781,267

[22] Filed: Mar. 25, 1977

[30] Foreign Application Priority Data

Mar. 29, 1976 [DE] Fed. Rep. of Germany ..... 2613277

[51] Int. Cl.[2] ..... B65B 11/28; B65B 49/08

[52] U.S. Cl. ..... 53/234; 53/196; 93/12 C; 93/77 R

[58] Field of Search ..... 53/234, 196; 93/12 C, 93/77 R

[56] References Cited

U.S. PATENT DOCUMENTS

| | | | |
|---|---|---|---|
| 3,829,952 | 8/1974 | Trask | 93/77 X |
| 3,978,639 | 9/1976 | Ferrozzi | 53/234 X |

*Primary Examiner*—Travis S. McGehee

*Attorney, Agent, or Firm*—Sughrue, Rothwell, Mion, Zinn and Macpeak

[57] ABSTRACT

The disclosure is of a cigarette or like packet of composite foil, with lateral end flaps separated from inner neighboring longitudinal end flaps but continuously connected with outer longitudinal end flaps and folded in between the inner and outer end flaps with the formation of overlying triangular lappets. For making and filling the packet there is an apparatus with winding mandrels to roll the foil into a tube, and a turret having devices for filling the tube and forming it into a closed packet by folding end flaps.

50 Claims, 20 Drawing Figures

Figure 1:
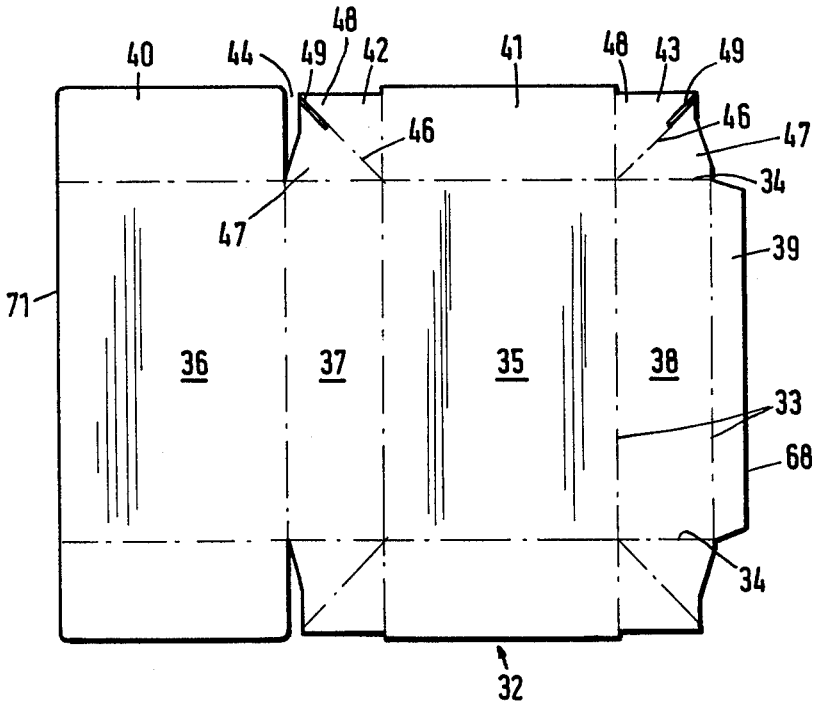

65
66
67
68
69
70
72
73
75
76
78
79
80
83
52
57
53
116
117
118
119
120
126
127
130
131
132
137
138
139
140
141
142
143
144
162
184
185
186
187
188
189
190
191
192
193

MEANS FOR THE PRODUCTION AND FILLING OF A PARALLELEPIPEDIC PACKET

This invention relates to a parallelepepedic packet made from a foldable cut-out shape, especially of composite foil, for the reception of articles of rod form, especially cigarettes, where the cut-out shape tubularly encloses the packet content and end flaps protruding at the ends are folded so that an inner longitudinal end flap rests on the packet content, two lateral end flaps are folded on to this longitudinal end flap and the second outer longitudinal end flap is folded on to the lateral end flaps and the inner longitudinal end flap. The invention further relates to a method and an apparatus for the production and filling of such a packet.

The invention is concerned primarily with cigarette packets of composite foils. These are fundamentally known. The mutlilayer assembly using layers of synthetic plastics material, paper and aluminium renders possible the production of largely aroma-tight packets from one single one-piece cut-out shape. This necessitates a new configuration of the packets and consequently of the packaging machines for the production and filling of such packets.

Starting from here, the invention is based upon the problem of proposing a packet of simple formation and material-saving production, also a method and an apparatus by which such a packet can be manufactured rationally and economically.

To solve the above-mentioned problem the packet according to the invention is characterised in that the lateral end flaps are separated by a separating cut or incision from the adjoining inner longitudinal end flaps, but are continuously connected with the outer longitudinal end flaps and folded in between the inner and the outer longitudinal end flaps, with formation of triangular lappets lying one upon the other.

The folding of end surfaces, which is always critical in such packets, is here relatively simple. An inner longitudinal end flap not connected with adjoining end flaps is folded freely directly against the packet content. Then the lateral end flaps connected with the outer longitudinal end flap are folded in over a diagonal fold line, taking the outer longitudinal end flap with them. Accordingly both on the inside of the packet and on its outside a longitudinal end flap extends over the whole area of the end side. Furthermore the packet has the advantage of being largely aroma-tight even in the region of these end folds.

The packet can be produced in a simple manner. According to the invention firstly a packet envelope of rectangular cross-section is formed and then the packet content is pushed in over an open end side of the packet, which is merely externally supported, in the longitudinal direction thereof. The tubular packet envelope is firstly produced by winding around a rotating winding mandrel with circular cross-section, and then shaped into the rectangular cross-sectional configuration. Thus packet sleeves folded very exactly with rectangular cross-section are formed.

The apparatus according to the invention consists of two mutually adjoining turrets, of which the first is provided with a number of rotating winding mandrels and the second with pockets to receive the initially empty packet sleeves. In the region of this second turret the two ends of the filled packets are folded and completed.

Further features of the invention relate to the design formation of the packet, to its production and filling and to the design of the apparatus.

Figure 2:
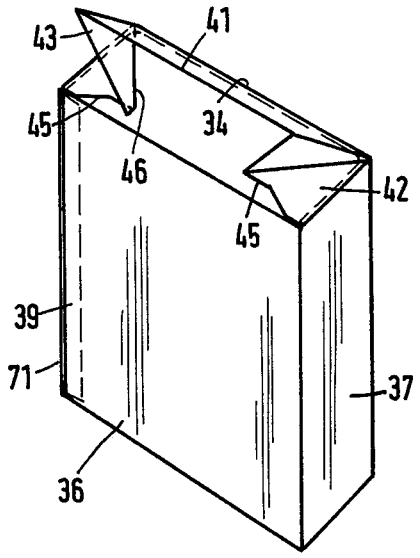
Figure 3:
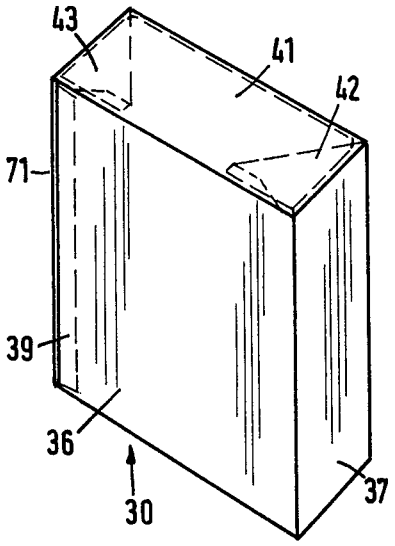
Figure 4:
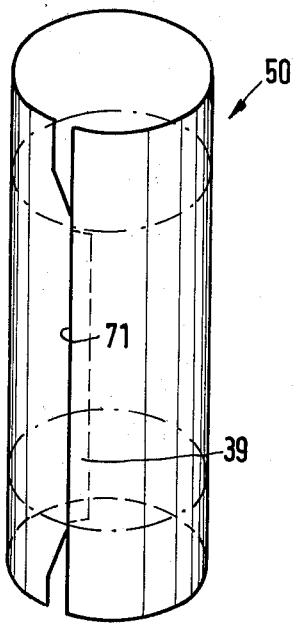
Figure 5:
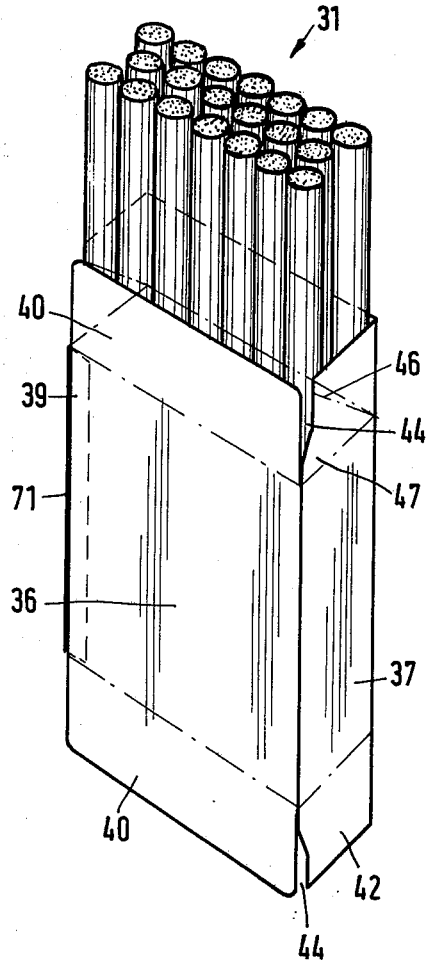
Figure 6:
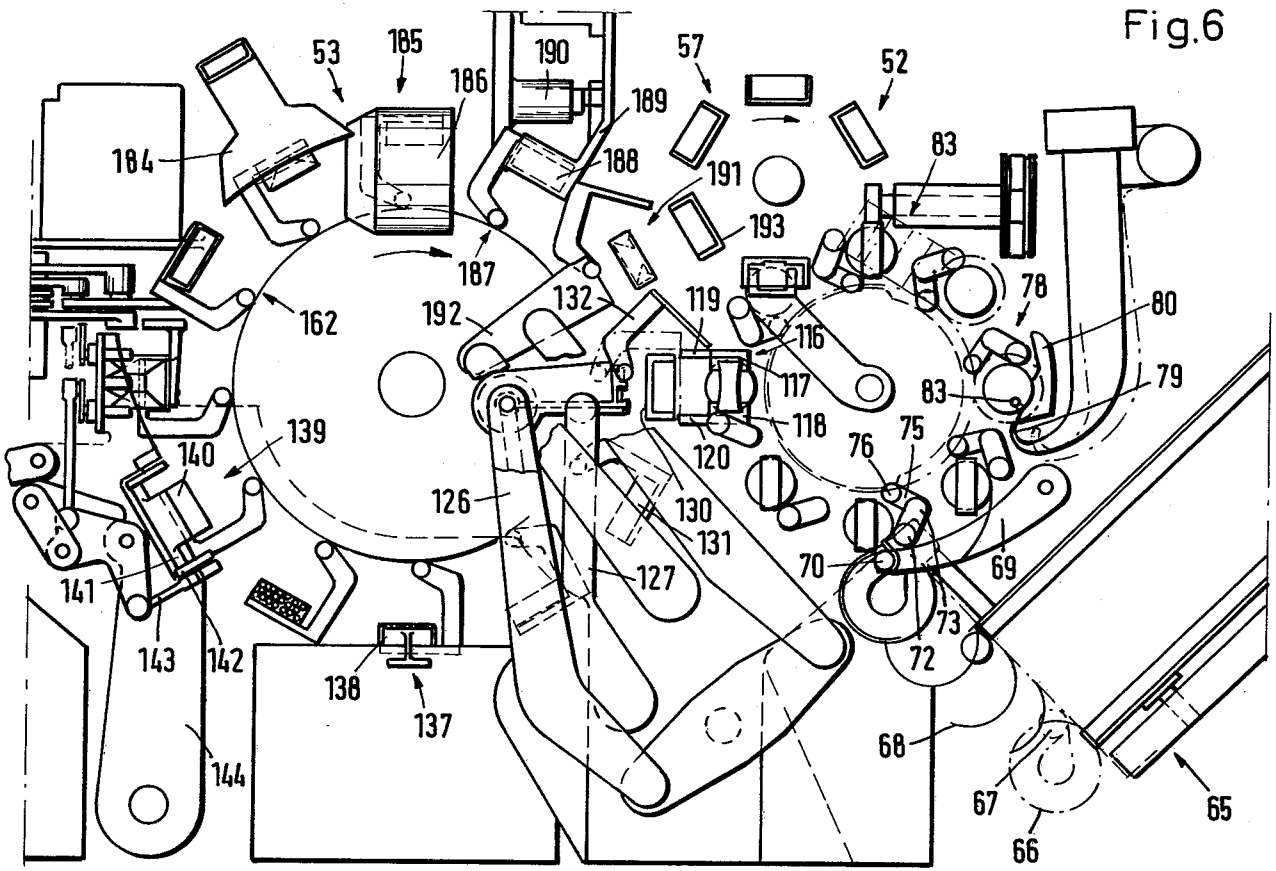
Figure 7:
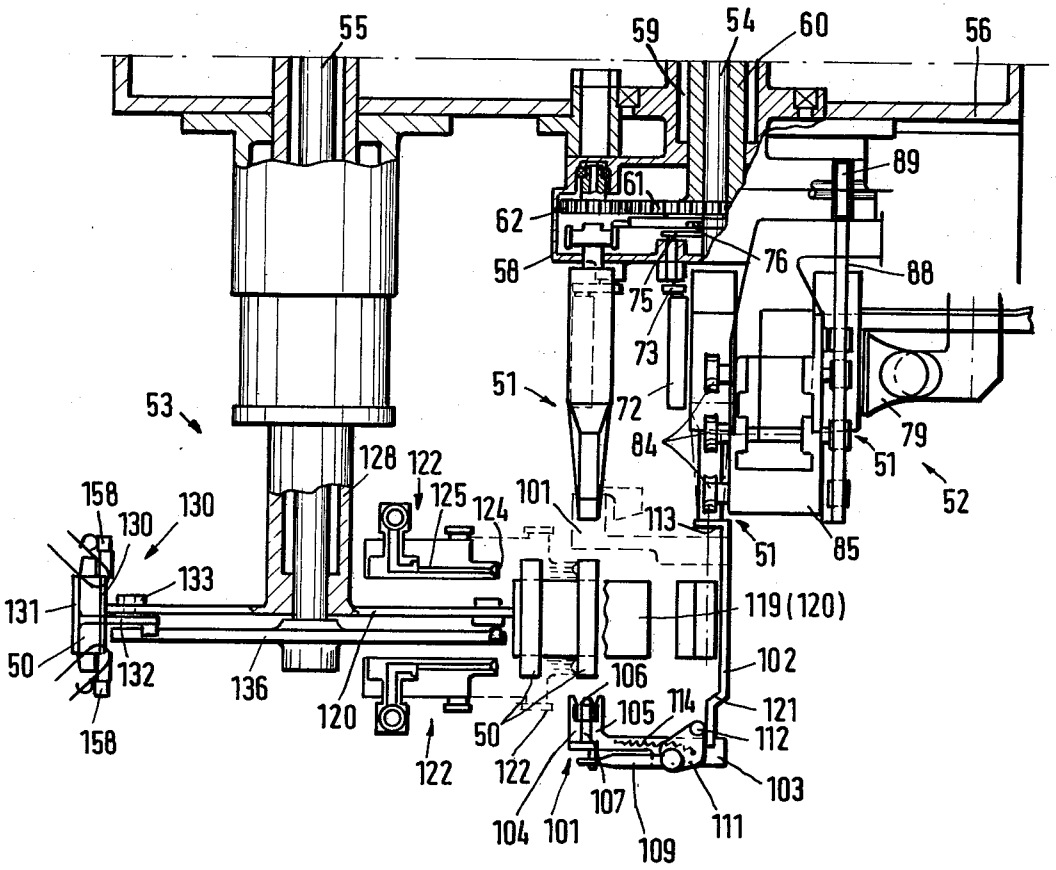
Figure 8:
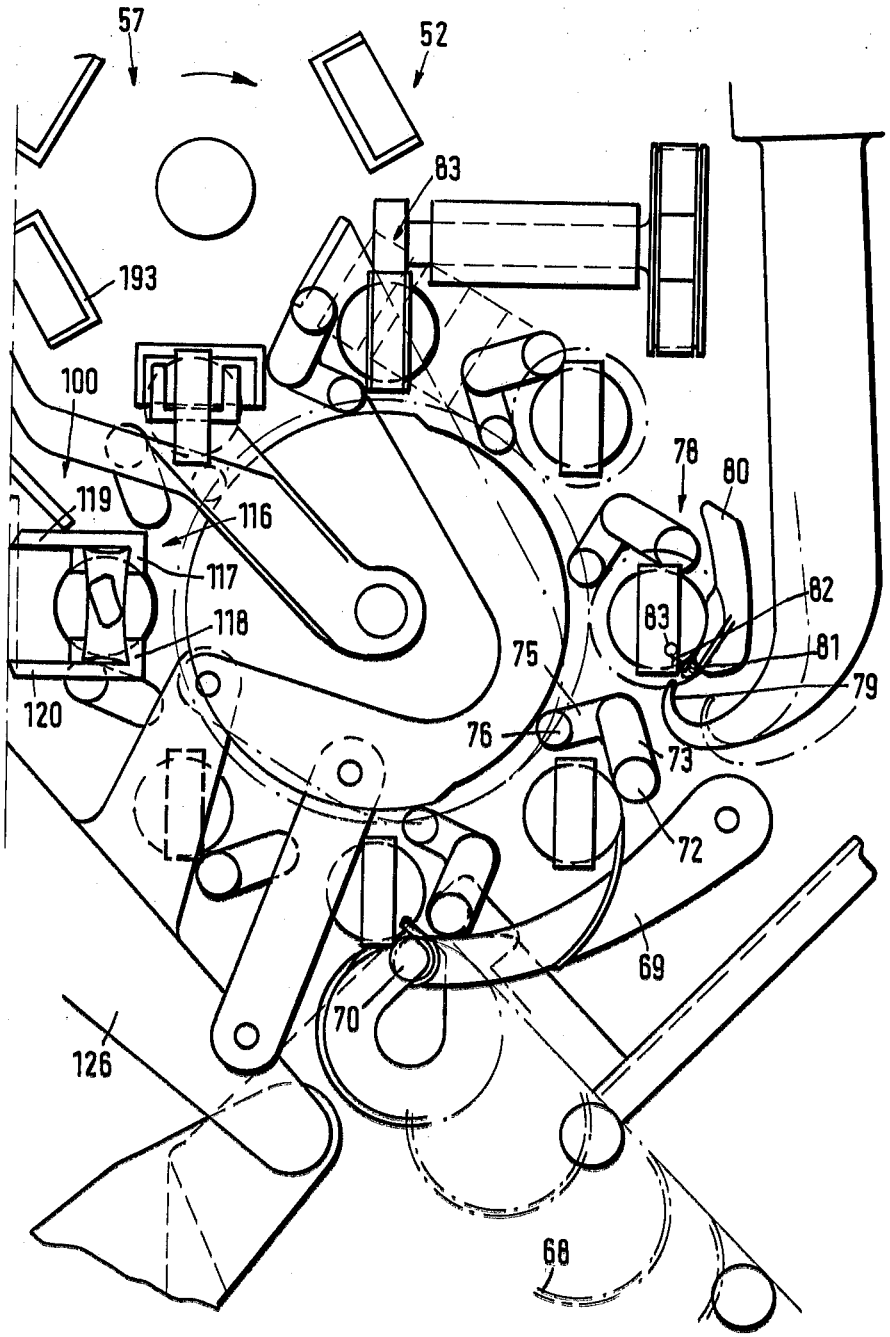
Figure 9:
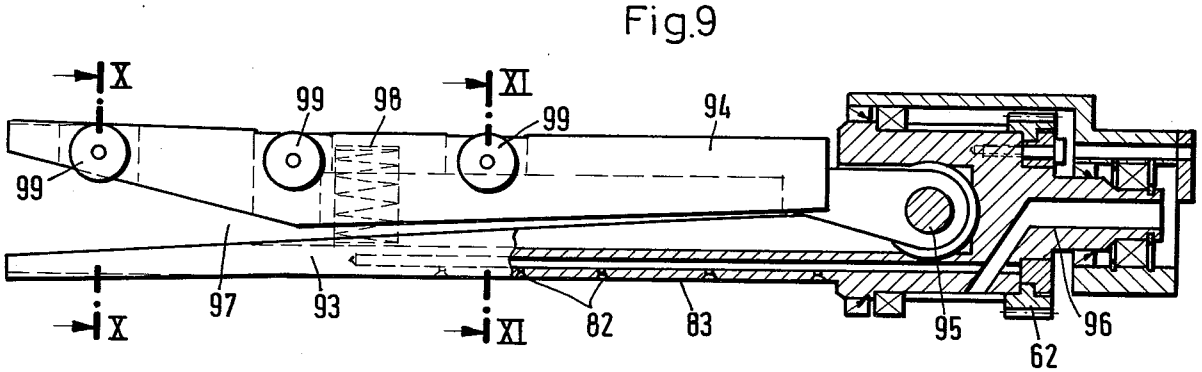
Figure 11:
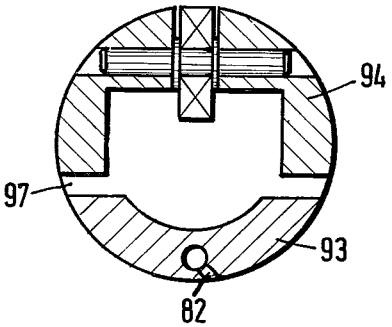
Figure 10:
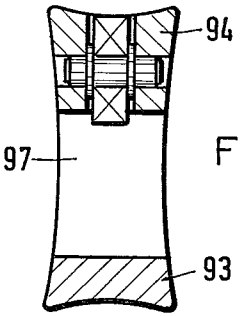
Figure 12:
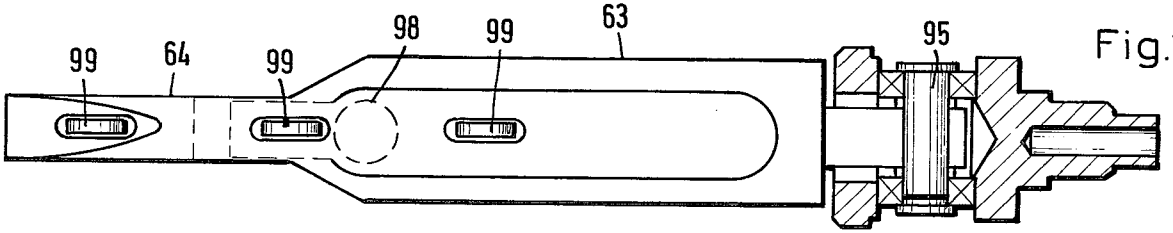
Figure 13:
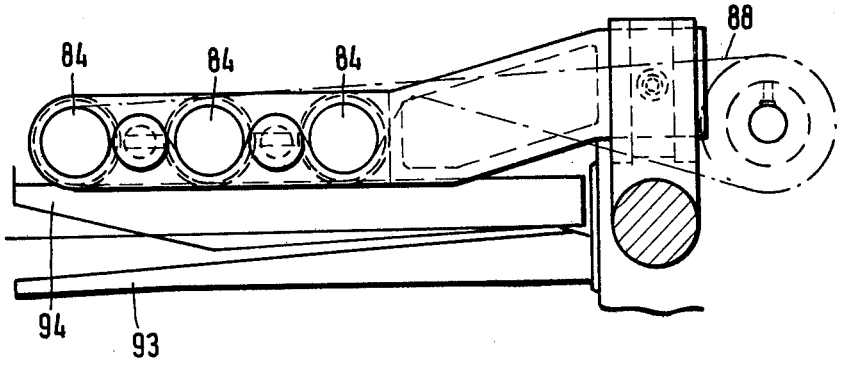
Figure 14:
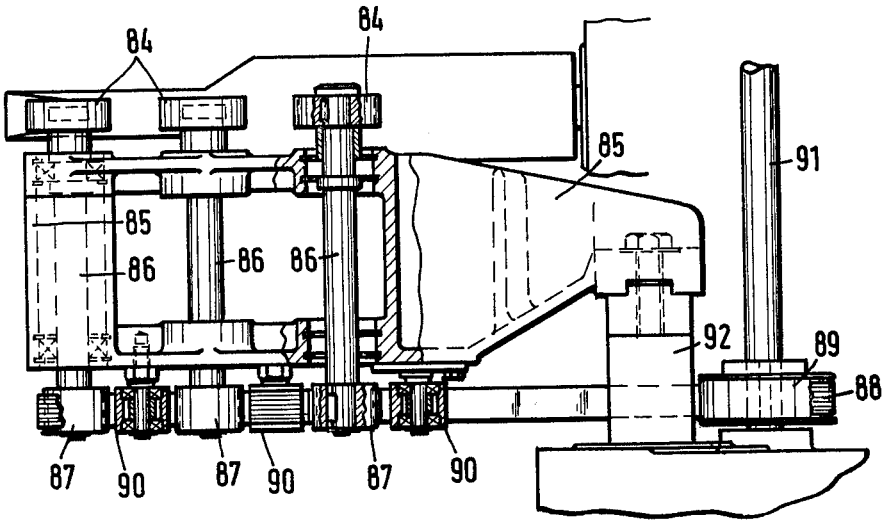
Figure 15:
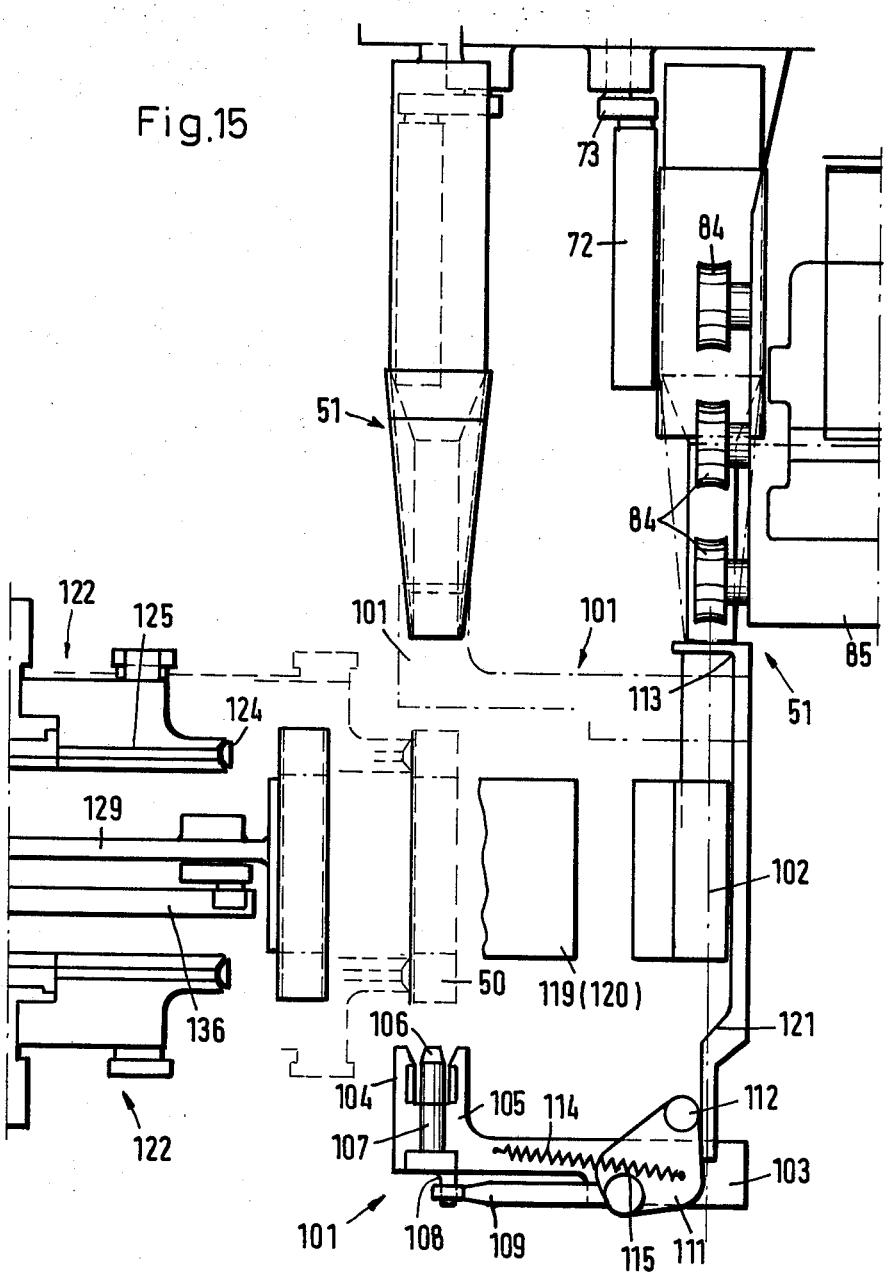
Figure 16:
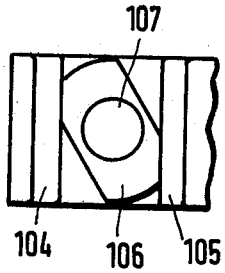
Figure 17:
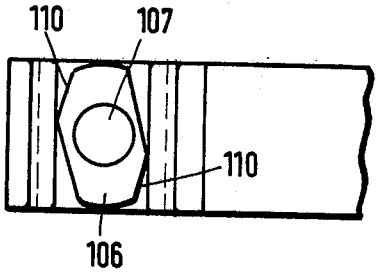
Figure 18:
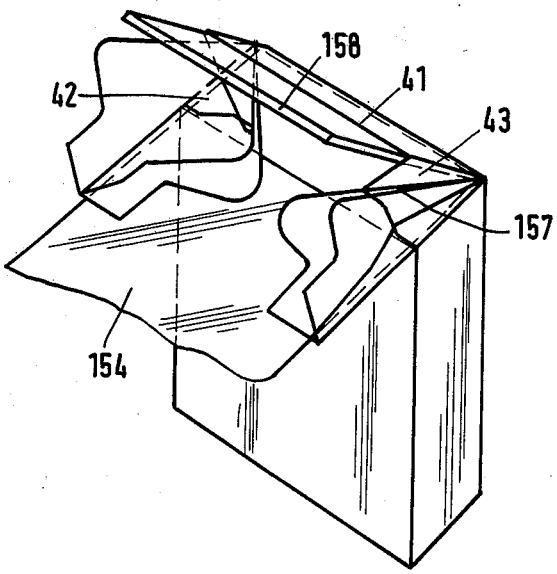
Figure 19:
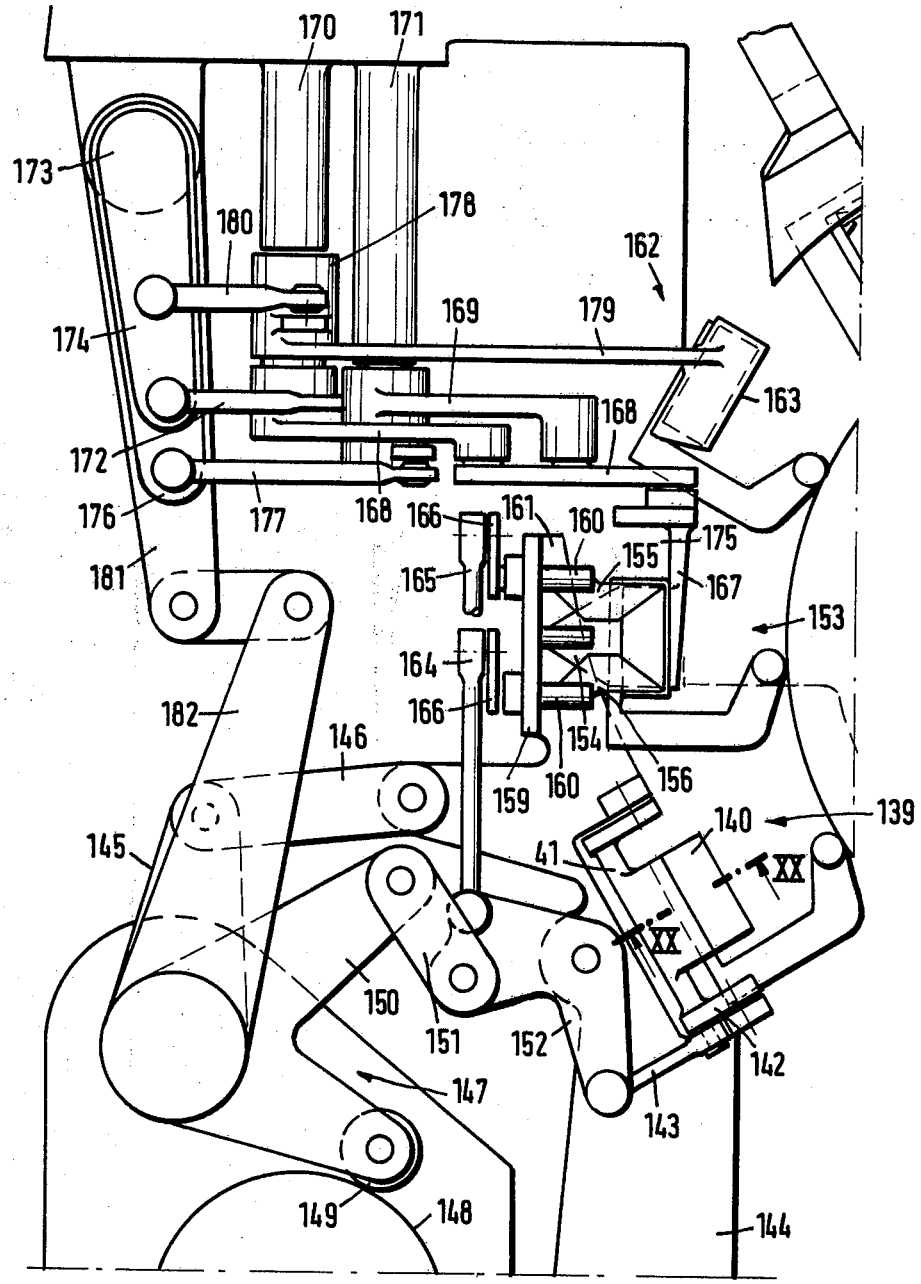
Figure 20:
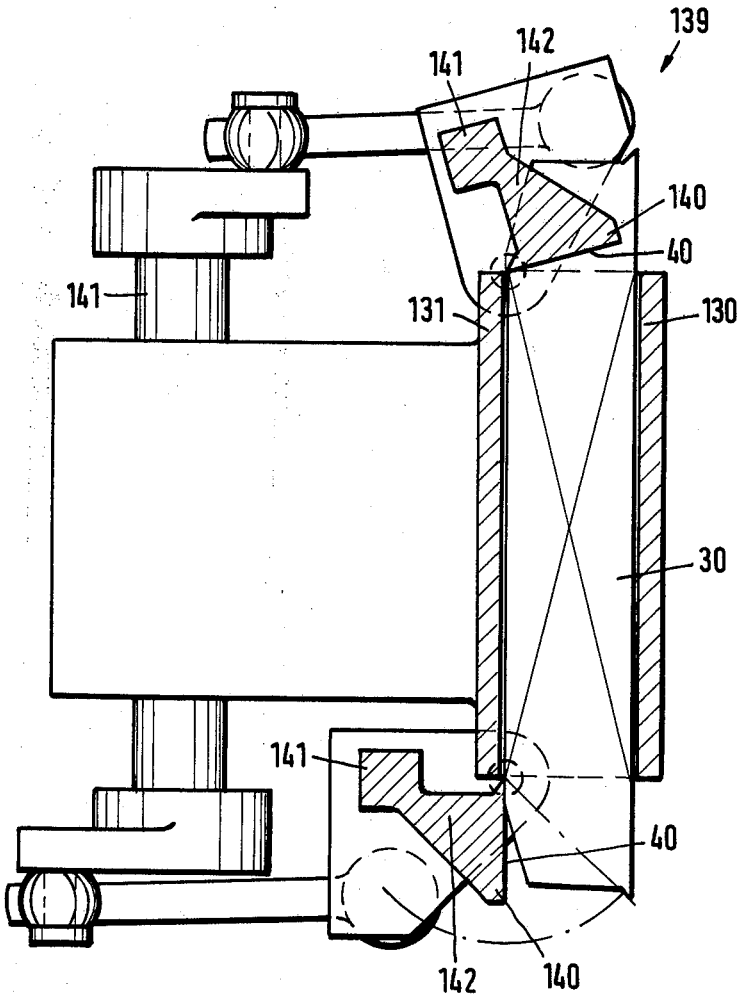

The invention will be explained in greater detail hereinafter by reference to an example of embodiment of the packet according to the invention and also of the apparatus for its production and filling, with reference to the accompanying drawings, wherein:

FIG. 1 shows a spread-out cut shape for the productionof a parallelepipedic packet, FIG. 2 shows a packet partially completed, namely except for the ends, in perspective view, FIG. 3 shows a view corresponding to FIG. 2 of the closed packet, FIG. 4 shows an intermediate position of the cut shape and the packet during its production, in perspective representation, FIG. 5 shows the packet prepared for the reception of the packet content, namely a group of cigarettes, likewise in perspective representation, FIG. 6 shows a simplified overall view of an apparatus for the production and filling of a packet according to FIGS. 1 to 5, FIG. 7 shows a plan view of FIG. 6, likewise greatly simplified, FIG. 8 shows a lateral elevation corresponding to FIG. 6 of a first turret of the apparatus, on a enlarged scale, FIG. 9 shows a winding mandrel of the turret according to FIG. 8 in lateral elevation, on a further enlarged scale, FIG. 10 shows a cross-section along the line X—X through the winding mandrel in FIG. 9, on an enlarged scale, FIG. 11 shows a further section along the line XI—XI in FIG. 9, likewise on an enlarged scale, FIG. 12 shows the winding mandrel according to FIG. 9 in plan view, FIG. 13 shows the winding mandrel according to FIGS. 9 to 12 with feed device for the cut shape, FIG. 14 shows a plan view of FIG. 13, FIG. 15 shows the region of the transference of the packet sleeves from the first turret to the second turret, in plan view, on a scale enlarged in comparison with FIG. 7, FIG. 16 shows a detail of a gripper for withdrawing the packet sleeve from a winding mandrel, in end view, on a scale larger than FIG. 15, FIG. 17 shows an illustration corresponding to FIG. 16 with a modified relative position, FIG. 18 shows the filled packet in perspective representation corresponding to FIG. 2, with diagrammatically illustrated folding members for the end flaps, FIG. 19 shows the folding members associated with the second turret for folding in the end flaps, in lateral elevation, FIG. 20 shows a section along the line XX-XX in the region of a folding station in FIG. 19, with different positions of folding members.

In the drawings, the packet 30 shown as example of embodiment is a parallelepipedic cigarette packet, that is it accommodates a cigarette group 31. The packet 30 consists of a one-piece cut-out shape 32, especially of composite foil. This is expediently divided by embossed longitudinal fold lines 33 and transverse fold lines 34 into areas intended for the formation of individual walls and flaps of the packet 30. In this way the front wall 35, rear wall 36 and side walls 37 and 38 are formed. The free edge of the side wall 38 is adjoined by a lateral strip 39 which is connected with the inside of the rear wall 36, with formation of a longitudinal seam, in a tubular intermediate fold position.

The narrow sides of the walls 35 to 38 are adjoined by end flaps, namely an inner longitudinal end flap 40, an outer longitudinal end flap 41 and lateral end flaps 42 and 43 arranged between and beside these. The above-mentioned end flaps 40 to 43 are folded into the end faces of the packet to form top and bottom walls.

The lateral end flaps 42 and 43 are connected with the outer longitudinal end flap 41 by the edges facing this flap and are defined merely by the correspondingly lengthened longitudinal fold lines 33. The lateral end flap 42 is divided off from the inner longitudinal end flap 40 by an incision 44. Due to this incision 44 the lateral end flap 42, and by corresponding shaping likewise the lateral end flap 43, has a width less than that of the end face of the packet, so that the edges 45 facing the free edge of the end face recede (see FIGS. 2 and 3). The lateral end flaps 42 and 43 are provided with a diagonal fold line 46 by which these lateral end flaps 42 and 43 are divided into two triangular lappets 47 and 48 in each case adjoining the side walls 37 and 38 and the outer longitudinal end flap 41.

The finished packet from such a cut-out shape 32 has an appearance with the inner longitudinal end flap 40 covering the full end face folded against the packet content. The lateral end flaps 42 and 43 are folded in between the inner longitudinal end flap 40 and the outer longitudinal end flap 41, with the triangular lappets 47 and 48 lying one upon the other.

Due to the set-back edges 45 the outer longitudinal end flap 41 receives direct abutment on and connection with the inner longitudinal end flap 40 along a marginal strip over almost the whole length of the end face.

The diagonal fold line 46 in the lateral end flaps 42 and 43 is conducted so that it does not run through the outer corners thereof, but at a distance therefrom. Thus the object is achieved that in the finished folded packet the edges 45 of the triangular lappets 47 and 48 of a lateral end flap 42 or 43 do not lie one upon the other in coincidence, but are staggered. Thus multi-layer steps are avoided. A further particular feature consists in that the diagonal fold lines 46 are provided from the free edge of the lateral end flaps 42 and 43 with a separating cut 49. This has the effect that the triangular lappets 47 and 48 are connected with one another in the region of the separating cut 49 with full area, that is without formation of a channel in the fold which otherwise occurs in the folding over of foil layers. The surfaces lying one upon the other, of the triangular lappets 47 and 48 and also of the longitudinal end flaps, can be connected with one another by adhesion, welding or the like.

For the production and filling of a packet 30 with the above features, firstly a packet tube 50 with open ends is formed from the cut-out shape 32. As preliminary stage of the packet tube 50, which is rectangular in cross-section in conformity with the finished packet 30 (FIG. 5), a packet tube 50 of circular cross-section is formed in that the cut-out shape 32 is wound or rolled without folding and the lateral strip 39 is connected with the free edge 71 of the rear wall 36 (FIG. 4). This packet tube 50 is formed by winding the cut-out shape 32 on to a winding mandrel 51 as solid core, rotating about its longitudinal axis. Then by shaping influencing of the packet tube from the interior and additionally from the exterior the packet tube of rectangular cross-section according to FIG. 5 is produced and this is filled by introduction of the cigarette group 31 in the longitudinal direction. Then the end flaps 40 to 45 are folded in the manner as described.

The apparatus as illustrated by way of example of embodiment for the production and filling of the packet 30 consists essentially of two turrets, namely a winding turret 52 and a folding turret 53. The two above-mentioned turrets 52 and 53 are mounted in and on a common housing 56 for rotation in cadence with multi-part shafts 54 and 55, which housing also accommodates two stepping gearings for the drive of the two turrets 52 and 53. The winding turret 52 serves for the production of the packet tube 50 according to FIGS. 4 and 5. The packet tube 50 of rectangular cross-section is transferred to the folding turret 53. In the region of this turret the packet tube 50 is filled by introduction of the cigarette group 31 and then finally folded in the region of the end faces.

Then follows a third turret 57 which takes over the finished packets 30 from the folding turret 53 and provides them with a tax stamp.

The winding turret 52 consists of a turret housing 58 of disc form which is driven in rotation in cadence by means of an external hollow shaft 59. Thus correspondingly several winding mandrels 51 unilaterally protruding and arranged along the periphery of the turret housing 58 on the front thereof also rotate. These elongated winding mandrels 51 are mounted in the turret housing 58 rotatably in relation thereto. For the drive of the winding mandrels 51 a planet wheel gearing is provided. This consists of a sun wheel 61 driven by an internally situated hollow shaft 60, and planet wheels 62 allocated one to each winding mandrel 51. The winding mandrels 51 are driven in rotation about their longitudinal axes at every step of the winding turret 52.

The conformingly formed winding mandrels 51 consist of a round part 63 facing the turret housing 58 and a rectangular part 64 extending to the free end (FIG. 12). The circular packet tube according to FIG. 4 is formed on the first-mentioned round part 63. By longitudinal displacement of this tube from the round part 63 on to the rectangular part 64 the packet tube 50 is thus brought from the interior into the rectangular cross-sectional configuration. The rectangular part 64 here completely fills out the cross-section of the packet tube 50.

The cut-out shapes 32 are taken in succession from the magazine 65 and fed to the winding turret 52, namely to a winding mandrel 51 situated in the transfer station. The taking over of the cut-out shape 32 from the magazine 65 and transport to the winding turret 52 are effected by a transport device known in principle with a take-off roller 66 which with the aid of suction bores (not shown) picks up a cut-out shape 32 in each case. By rotation of the take-off roller 66 about its longitudinal axis and movement along the under side of the magazine 65, the cut-out shape 32 is transported, being rolled on the take-off roller 66.

In the present case with the take-off roller 66 there is associated a stop 67 which is merely translationally movable therewith. The relative position between this stop 67 and the take-off roller 66 is so selected that the side strip 39 of the cut-out shape first taken up by the take-off roller 66 receives abutment with its free edge 68 on this stop 67.

In the region of the transference of the cut-out shape 32 to a winding mandrel 51 of the winding turret 52 likewise a fixed, invariable relative position is predetermined, namely in such a way that the cut-out shape 32, fixed in its end position by the stop 67, can be passed with the edge 68 and the side strip 39 to the winding mandrel 51 in a specific and constantly recurring relative position, so that an exact position of the cut-out shape 32 on the winding mandrel 51 is guaranteed. This transference is effected by a presser roller 70 mounted on a reciprocally pivotable arm 69, which roller lifts the free edge 68 and the side strip 39 of the cut-out shape 32 away from the take-off roller 66, the arm 69 carrying out a pivoting movement, and presses it on the periphery of the winding mandrel 51 in the region of the round part 63. By retraction of the take-off roller 66 into the initial position and by the further movement of the winding turret 52, with rotation of the winding mandrel 51 about its own longitudinal axis, the cut-out shape 32 is withdrawn from the take-off roller 66 and gradually wound around the round part 63.

The round part 63 is dimensioned so that the cut-out shape 32 collected by winding encloses the round part 63, one edge 71 being overlapped with the side strip 39.

The cut-out shape 32 is fixed on the winding mandrel 51, namely pressed against it, until the completion of the circular packet tube 50. For this purpose with each winding mandrel 51 there is associated a presser roller 72. This is mounted on a crank arm 73 the shaft 74 of which leads into the turret housing 68. On the inner end of the shaft 74 a further crank arm 75 is fitted which runs with a support roller 76 on a cam disc 77. The cam disc 77 is formed so that the presser roller 72 is lifted away from the packet tube 50 after its completion, according to FIG. 4. The presser rollers 72 and the crank gearing 73, 74, 75 are subject to the loading of a spring (not shown) which presses the presser roller 72 against the winding mandrel 71 and the support roller 76 against the cam disc 77 when the presser roller 72 is lifted away.

The mutually overlapping parts of the cut-out shape, namely the edge 71 of the rear wall 36 and the side strip 39, are activated in the region of a welding station 78. For this purpose the above-mentioned edge regions of the cut-out shape are firstly fixed so that the edge 71 is guided tangentially. Thus a somewhat bridge-shaped gap is produced between the side strip 39 and the edge 71. Into this an activating medium, hot air in the case of thermally activatable surfaces, is introduced through a pivotably mounted hot air nozzle 79. The edge 71 is here fixed by a retaining jaw 80 which is equipped with suction bores 81 at least in the region of the edge 71. The winding mandrel 51 is also provided, at least in the opposite region, with suction bores 82 which hold the side strip 39 on the winding mandrel 51. The last-mentioned suction bores 82 are connected to a suction conduit 83 of the winding mandrel 51, extending parallel with the axis. The air supply is here controlled centrally in known manner. The activated edge regions of the cut-out shape are connected with one another by the presser roller 72, after leaving the welding station 78.

Then the packet tube 50 is displaced in a shifting station 83 in the axial direction on the winding mandrel 51, namely from the round part 63 on to the rectangular part 64. This movement is effected by conveyor members acting on the external periphery of the relevant winding mandrel 51. In the present case these are several, for example three, transport rollers 84 which abut externally on the packet tube 50 and displace the packet tube 50 by frictional drive.

The transport rollers 84 are mounted laterally on a pivot arm 85 which is movable so that the transport rollers 84 in the pivoted-away position abut on the upper side of the periphery of the winding mandrel 51. The transport rollers 84 are mounted on a shaft 86 each, which extend transversely through the pivot arm 85 and are driven on the opposite side. For this purpose a drive pulley 87 is seated on the end of each of the shafts 86. The drive pulleys are driven by a common belt 88 which runs over a driving pulley 89 and loops round all drive pulleys 87. For this purpose idler pulleys 90 likewise looped by the belt 88 are mounted on the pivot arm 85 between the drive pulleys 87. The driving pulley 89 is driven centrally through a shaft 91. The pivot arm 85 is fixed pivotably exclusively in the region of a bearing 92.

The winding mandrel 51 is made compressible, namely especially for the execution of axial displacements of the packet tube 50. In the example of embodiment as illustrated the winding mandrel consists of two parts, namely a lower base part 93 and an upper pivot part 94. The latter is pivotable in relation to the base part 93 and held by a corresponding pivot bearing 95 in a common carrier part 96. The latter is formed with a toothed rim to form a planet wheel 62 of the planet wheel gearing.

Between the base part 93 and the pivot part 94 a gap 97 is formed which widens towards the free end of the winding mandrel 51. The pivot part 94 is pivotable in relation to the base part 93, reducing this gap 97, namely against the load of a compression spring 98. A pivoting movement in the compressing direction is carried out in the present case by the pivot arm 85 when its drive pulleys 87 abut on the winding mandrel 51 or the packet tube 50. The cross-section of the winding mandrel 51 is thereby reduced and the axial transport of the packet tube 50 is facilitated.

For further facilitation of this axial displacement of the packet tube 50 the winding mandrel 51, namely its pivot part 94, is equipped with counter-rollers 99. These are mounted within the pivot part 94 so that they lie with a circumferential section approximately directly beneath the packet tube 50. The relative position of the counter rollers is such that they cooperate with the drive pulleys 87 of the pivot arm 85, in fact enclosing the packet tube 50 between them.

When the packet tube 50 is conveyed in the described manner into the region of the rectangular part 64 of the winding mandrel 51, the packet tube 50 is provided with the rectangular cross-section according to FIG. 5. Now the packet tube 50 is completed. In the region of an expulsion station 100 the packet tube 50 leaves the winding mandrel 51. In this renewed axial movement the drive pulleys 87 of the pivot arm 85 and the counter rollers 99 again participate in the manner as already described.

The packet tube 50 is furthermore withdrawn from the winding mandrel 51 in the region of this expulsion station 100. For this purpose in the present case a reciprocally movable gripper 101 is provided in this station. This gripper is mounted displaceably on a central rod 102 with a bearing block 103.

The gripper 101 consists of two outer jaws 104, 105 and a movable counter-piece arranged between these in the form of a double-acting inner jaw 106. The latter is seated on a rotary rod 107 which is rotatable by a crank 108 with adjoining push rod 109.

By driving of the bearing block 103 on the central rod 102 the gripper 101 is driven out of the initial position as shown in FIG. 7 and FIG. 15 to the free end of a winding mandrel 51, namely in the region of the gap 97 formed between the base part 93 and pivot part 94. The ends of the outer jaws 104, 105 and of the inner jaw 106 enter this gap. In the initial position the inner jaw 106 is here rotated so that there is a sufficient distance from the outer jaws 104 and 105 for the introduction of the walls and the protruding longitudinal end flaps 40 and 41 between the outer jaws 104 and 105 on the one hand and the inner jaw 106 on the other (FIG. 17). The inner jaw 106 is then rotated, in the counterclockwise direction in FIGS. 16 and 17. Thus the inner jaw 106 abuts with clamping faces 110 on the outer jaws 104 and 105 and on the introduced parts of the packet tube 50. Now the packet tube 50 is withdrawn from the winding mandrel 51 by retraction of the gripper 101 with the bearing block 103.

The push rod 109 for the actuation of the inner jaw 106 is loaded by a pivot piece 111 which is pivotably connected with the facing end of the push rod 109. On the pivot piece 111 a support roller 112 is fitted which runs on a rollway. At the end of this rollway a stop 113 is provided against which the support roller 112 runs in the displacement of the gripper 101, with the consequence that the pivot piece 111 is pivoted, actuating the push rod 109. This is the moment of opening of the gripper 101 by rotation of the inner jaw 106 into the position according to FIG. 17. The gripper 101 is spring-loaded in the closing direction. In the present case a tension spring 114 is associated with the pivot piece 111 and constantly charges the pivot piece 111 in the closing direction of the gripper 101 and the inner jaw 106. The pivot piece 111, pivotable about a journal 115, is situated in a stable position after passing a dead point position when the gripper 101 is in the open and in the closed position. This occurs due to the position of the tension spring 114 in relation to the journal 115.

The packet tube 50 withdrawn from the winding mandrel 51 is drawn through a matrix 116. This consists of upper part 117 and lower part 118. The two are arranged with spacing from one another so that the above-explained gripper 101 can pass through between the upper part 117 and lower part 118. Moreover the dimensions are so selected that the packet tube 50 of rectangular cross-section can be conducted fitting through the matrix 116, stabilising the rectangular configuration and supporting the edge folding. Upper part 117 and lower part 118 are formed in cross-section for this purpose so that the walls of the packet, namely the front wall, the rear wall and side walls, are domed inwards slightly, forming a sharp-edged corner folding.

The matrix 116 is followed by a table consisting of upper guide 119 and lower guide 120. The packet tube 50 is set with the side walls 37 and 38 directed upwards and downwards respectively on this table and liberated by the gripper 101, in that the support roller 112 of the pivot piece 111 runs up on to a cam piece 121. This is arranged at the end of the rollway opposite to the stop 113.

The table with its upper guide 119 and lower guide 120 is arranged opposite to the folding turret 53. The packet tube 50 is now taken over by the latter. Transference is completed with the aid of a drive member 122, two of which are arranged on both sides of the folding turret 53. The drive members 122 are provided on protruding noses 123 with suction bores 124 connected to suction passages 125. With the aid of the charged suction bores 124 the noses 123 in each case grasp a packet tube 50 in the region of the facing protruding longitudinal end flaps 40 or 41. For this purpose the drive members 122 seated on levers 126 and 127 are moved to and fro.

The folding turret 53 consists of a turret disc 129 driven by a hollow shaft 128, with pockets 130 arranged on its periphery each to receive a packet tube 50. The packet tube 50 is received, with axially parallel position with the folding turret 53, into the pockets 130 which are open at the axial ends and radially outwards. For this purpose the pockets 130 have a U-shaped cross-section. With each pocket there is associated a pivotally mounted outer lid 131 which covers the pocket 130 on the radially outer side. In the region of introduction of a packet tube 50 into a pocket 130 by the drive member 122 the outer lid 131 fitted on a pivot arm 132 is in each case pivoted away from the pocket 130. For this purpose the pivot arm 132 fitted with a bearing journal 133 on the turret disc 129 is supported with a guide roller 134 arranged on the free end on a cam disc, or guided in a guide slot 135 of a cam disc 136. This controls the opening and closing movements of the outer lid 131.

The packet content, namely the cigarette group 31, is fed by a suitable conveyor 138 in the region of a filling station 137 of the folding turret 153 to the packet tube 50 seated in the closed pocket. The cigarette group 31 is pushed axially parallel with the folding turret 53 by way of one of the open ends into the packet tube 50.

In a following first folding station 139 the first folding step as described is completed, namely the inner longitudinal end flap 40 is folded against the packet content. For this purpose a folder 140 is provided which is fitted on a rotatably mounted crank shaft 141. The latter is provided with a crank arm 142 at both ends, which arm again is movable by a link 143. The link 143 is part of an operating linkage with a main arm 144 by which the folding tool, namely the folder 140, with the pertinent operating linkage can be pivoted to the folding turret 53 and to the relevant pocket thereof.

The main arm 144 is pivotable about a stationary bearing (not shown) for the pivoting of the folding tools to and from the folding turret 53. The reciprocating rocking movements of the main arm 144 are triggered by a likewise reciprocally movable crank arm 145. An intermediate link 146 transmits its movements to the main arm 144.

An angle arm 147 is reciprocally pivotably mounted as main drive means coaxially with the crank arm 145. The movements of this angle arm 147 are controlled by a rotating cam disc 148 on the periphery of which an arm 149 of the angle arm 147 runs with a feeler roller.

On the free end of the other arm 150 of the angle arm 147 a transmission link 151 is fitted which again transmits the movements of the angle arm 147 to an actuating arm 152. On the one end of this two-legged or two-armed actuating arm 152 the link 143 for the actuation of the folder 140 is arranged. The actuating arm 152 is pivotably mounted on the main arm 144, accordingly it is part of an applicable and retractable folding linkage.

The movement of the folder 140 occurs according to FIG. 20 in a manner such that the folder is pivoted over with the longitudinal end flap 40 out of the upright position into the plane of the end face. The (imaginary) pivot axis lies at the edge of the packet.

A subsequent second folding station 153 serves for the completion of the end folding, that is for the simultaneous folding in of the lateral end flaps 42 and 43 with the outer longitudinal end flap 41. The folding tools provided for this purpose and the course of the folding operations will be explained with reference to FIG. 18. A support plate 154 which rests on the already folded inner longitudinal end flap 40 is driven into the lateral ends flaps 42, 43, initially extending in U-form, with longitudinal end flap 41. To fold in the lateral end flaps 42, 43 lateral fold-in members 155 and 156 of sheet-metal form are provided. In an initial position these are directed approximately perpendicularly of the end face of the packet, in fact extending at the edge of the end face. By pivoting of these lateral fold-in members 155 and 156 into the plane of the end face the lateral end flaps 42, 43 are entrained and folded inwards. The lateral fold-in members 155, 156, which are approximately triangular in the region of the lateral end flaps 42, 43, here place themselves against and on the lower triangular lappets 47, while an edge 157 of the lateral fold-in members 155, 156 extends in the channel formed by the diagonal fold line 46 between the triangular lappets 47 and 48. The pivoting movement of the lateral fold-in members 155 and 156 is continued until the position approximately in the plane of the end face.

With the outer longitudinal end flap 41 there is associated a guide plate 158 as essential folding member. This enters the end region of the packet not yet folded, so that it rests on the inner side of the outer longitudinal end flap 41. Synchronously with the lateral fold-in members 155, 156 the guide plate 158 is pivoted out of an upright position into the plane of the end face, whereby the end folding is practically completed. The said folding members, namely the support plate 154, the lateral fold-in members 155 and 156 and the guide plate 158, are then withdrawn on the open side from the end flaps lying folded one above the other.

The movement of the above-mentioned fold-in members is adapted to the folding members and actuating means allocated to the folding station 139. For this purpose the support plate 154 and the lateral fold-in members 155 and 156 are mounted on a common carrier 159. The lateral fold-in members 155 and 156 are pivotable in relation to this carrier 159 about axes 160. The carrier 159 is fitted on an extension 161 of the main arm 144, so that the described folding tools are applied and pivoted away with and by this main arm 144.

The folding station 153 is followed by a closer station 162. In this the folded end flaps 40 to 43 in the closed position are again subjected to a closure pressure by a presser plate 163 moved against each of the end faces of the packet. The above-described folding and closing members of the stations 139, 153 and 163 are operated by a linkage moved in mutual dependence.

For the execution of the pivoting movements of the lateral fold-in members 155 and 156 a push rod 164 and 165 for each is connected to the operating arm 152 and acts through a crank arm 166 upon a shaft leading to the respective lateral fold-in member 155 and 156. This shaft is rotatably mounted in the carrier 159. The push rods 164 and 165 act upon the end of the two-armed operating arm 152 opposite to the link 143 for the folder 140. The above-mentioned folding members are accordingly applied to the respective folding stations 139 and 153 in common by the main arm 144, and then actuated from one common member, namely the angle arm 147.

For the guide plate 158 likewise means are provided for its application to the folding station 153, and further means are provided for pivoting. For this purpose the guide plate 158 is fitted on a carrier arm 167 which is pivotably mounted through links 168 and 169 on carrier rods 170 and 171. For carrying out the application movements the link 169 is operated by a crank arm 172 which again is connected with a pivot arm 174 mounted on a central shaft 173.

The pivoting movements of the guide plate 158 brought into position are effected by a crank 175 which acts directly on the correspondingly angled carrier arm 167 and carries out the pivoting movements about the longitudinal axis thereof. The crank 175 is in gear connection with a further pivot arm 176 mounted on the central shaft 173. In FIG. 19 of these parts only one crank arm 177 on the end of the pivot arm 176 is illustrated. This crank arm 177 is connected with the crank 175 through intermediate members (not shown).

A further gearing for the movement of the presser plate 163 is mounted with a pivot bearing 178 on the carrier rod 170. From the pivot bearing 178 a retaining rod 179 leads to the presser plate 163. The pivot bearing 178 is pivotable by a crank arm 180 which is mounted also on the pivot arm 174. The central shaft 173, which for the execution of the different movements consists of an inner shaft and of a hollow shaft surrounding the latter, is driven through a shaft arm 181 by a main crank 182 which is mounted coaxially with the angle arm 147 and is moved by the arm of the latter running with the feeler roller on the cam disc 148. Shaft arm 181 and main crank 182 are arranged doubly, lying one behind the other. They act in each case upon the inner shaft and the hollow shaft of the central shaft 173.

By the gearing as explained above the folding tools allocated to the stations 139 and 153 are applied in common to the folding turret 53. Furthermore all tools of the stations 139, 153 and 162 are moved by central actuation.

The closing station 162 is followed by an activation station 183. In this station 183 the surfaces of the end flaps 40 to 43 to be connected with one another are activated by heat, namely especially plasticised. For this purpose a wide slot nozzle 184 for the supply of hot air enters the ends of the packet, which are still partly open by reason of the material rigidity. The position of the end flaps 40 and 43 is here approximately as indicated in FIG. 2. The slot nozzle 184 enters the formed wedge-shaped gap. Thus the surfaces of the longitudinal end flaps 41, 42 and of the triangular lappets 47 and 48 facing one another are activated by the application of heat.

In the following presser station 185 the activated end flaps 40 to 43 are pressed into the plane of the end face, for example by a presser roller 186 moving over the end faces of the packet. Thus the end flaps are moved into the position according to FIG. 3 the activated surfaces being connected with one another by thermal welding or the like.

The action of the presser roller 186 is completed in a subsequent finisher station 187. Here a press plate 188 is driven against the end faces of the packet. The press plate 188 is mounted on an arm 189 which is here moved by an eccentric drive 190. The subsequent station is the expulsion station 191 for the completed packets. With the outer lid 131 pivoted away, the packet is expelled from the pocket by a push member 192 which enters the pocket 130 of the folding turret 53 from the interior in the radial direction, and the packet enters an opposite socket 193 of the turret 57 for the fitting of a revenue stamp to the finished packet. The revenuestamped packets are taken in suitable manner from this turret 57 and conveyed away.

We claim:

1. An apparatus for the production of parallelepipedic packets from a foldable cut-out shape of composite foil for the reception of cigarettes, the cut-out shape tubularly enclosing the packet content and having protruding end flaps folded over the end faces of the cigarettes, characterised by: a winding turret (52) having a plurality of mandrels (51) mounted thereon, each for the reception of a cut-out shape (32) for the production of a packet tube (50), means for rotating the mandrels about their own longitudinal axes, a folding turret (53) having devices mounted thereon for filling the packet tube (50) and closing it by folding its end flaps (40 to 43), and means for transfering the packet tube from the winding mandrels to the folding turret.

2. An apparatus according to claim 1, characterised in that the winding mandrels (51) are individually mounted on a turret housing (58) of the winding turret (52) projecting outwardly therefrom.

3. An apparatus according to claim 2, characterised in that the winding mandrels (51) are rotatably driven about their own longitudinal axes in synchronism with the rotation of the winding turret (52).

4. An apparatus according to claim 3, characterised in that the means for rotating the winding mandrels (51) comprises a planet wheel gearing accommodated in the turret housing (58), a planet wheel (62) being mounted on each winding mandrel (51) and a sun wheel (61) being mounted in the turret housing (58).

5. An apparatus according to claim 4, characterised in that the cut-out shape (32) can be placed with a side strip (39) upon the periphery of the winding mandrel (41) and is windable with pressing upon the periphery of the winding mandrel (51) on rotation thereof.

6. An apparatus according to claim 5, characterised in that the cut-out shape (32) is pressable against the periphery of the winding mandrel (51) during the formation of the packet tube (50) by a presser roller (72) axially parallel with the winding mandrel (51).

7. An apparatus according to claim 5, characterised in that the winding mandrel (51) is equipped with suction bores (82) in the region of abutment of the edge of the cut-out shape (32) first applied for detachable fixing of the cut-out shape (32).

8. An apparatus according to claim 5, characterised in that the cut-out shapes (32) are applicable to the winding mandrel (51) with a constantly recurring exact position in relation thereto by movement of an edge (68) of the cut-out shape (32) against a stop (67) fitted in a fixed relative position to the winding mandrel (51).

9. An apparatus according to claim 8, characterised in that the stop (67) is movable with a take-off roller (66) for the withdrawal of the cut-out shapes (32) from a magazine (65) such that in the end position facing the winding mandrel (51) the stop (67) assumes a constantly recurring position in relation to the winding mandrel (51).

10. An apparatus according to claim 5 characterised in that the side strip (39) of the cut-out shape (32) first applied to the winding mandrel (51) is momentarily fixed on the periphery of the mandrel (51) by a presser roller (70).

11. An apparatus according to claim 10, characterised in that the presser roller (70) is movable to the winding mandrel (51) and pivotable away from it by a pivotable arm (69).

12. An apparatus according to claim 11, characterised in that for the connection of the mutually over-lapping edge regions of a rear wall (36) and the side strip (39) of the cut-out shape (32) in the formation of the packet tube (50), for their activation they are fixable in a wedge-shaped relative position to one another by support elements and activatable on the surfaces to be connected with one another by the blowing of hot air into the wedge-shaped gap.

13. An apparatus according to claim 12, characterised in that the edge region of the cut-out shape (32) lying opposite to the side strip (39) is fixable in the position forming a wedge-shaped gap by a retaining jaw (80) provided with suction bores (81) and arranged in a welding station (78).

14. An apparatus according to claim 13, characterised in the each winding mandrel (51) is formed from a round part (63) for the reception of the cut-out shape (32) forming a packet tube (50) of circular cross-section and a rectangular part (64) for the formation of a packet tube (50) of rectangular cross-section.

15. An apparatus according to claim 14, characterised in that the packet tube (50) is displaceable by axial conveying on the winding mandrel (51) out of the region of the round part (63) into the region of the rectangular part (64).

16. An apparatus according to claim 15, characterised in that for the axial conveying of the packet tube (50) on the winding mandrel (51) a conveying means is applicable in the region of a displacement station (83) to the winding mandrel (51) and the packet (50), a number of driven conveyor rollers (84) following one another in the axial direction.

17. An apparatus according to claim 16, characterised in that the conveyor rollers (84) are mounted on a common pivot arm (85) and drivable in common by a driving pulley (89) through shafts (86) by a belt or the like.

18. An apparatus according to claim 15, characterised in that the winding mandrel (51) is equipped with counter rollers (99) which are rotatably mounted so that they abut on the inner side of the packet tube (50) opposite to the conveyor rollers (84) of the pivot arm (85).

19. An apparatus according to claim 6, characterised in that the presser rollers (72) are each liftable away from the associated winding mandrel (51) due to the fact that the presser roller (72) resting under spring loading or the like on the winding mandrel (51) is liftable away against the spring loading by control of a cam disc (77) through a crank gearing (73, 74, 75, 76) for the execution of axial displacements of the packet tube (50) on the winding mandrel (51).

20. An apparatus according to claim 19, characterised in that the winding mandrel (51) is of two-part formation consisting of a base part (93) and a pivot part (94), the latter being pivotable in relation to the base part for the reduction of the cross-section of the winding mandrel (51).

21. An apparatus according to claim 20, characterised in that the base part (93) and pivot part (94) are compressible against the loading of a compression spring (98) by pivoting of the pivot part (94) in relation to the base part (93).

22. An apparatus according to claim 20, characterised in that for the reduction of the cross-section the pivot part (94) is pivotable by the pivot arm (85) or by the conveyor rollers (84) arranged thereon when they abut on the winding mandrel (51).

23. An apparatus according to claim 22, characterised in that the packet tube (50) shaped by the rectangular part (64) into a rectangular cross-section is withdrawable in the region of an expulsion station (100) in the axial direction from the winding mandrel (51) and can be fed to the folding turret (53).

24. An apparatus according to claim 23, characterised in that the packet tube (50) is stabilisable as regards the rectangular cross-section during the withdrawal movement by a matrix (116) formed with rectangular cross-section and externally enclosing the packet tube (50), through which matrix the packet tube (50) can be drawn.

25. An apparatus according to claim 24, characterised in that the matrix (116) is so formed and dimensioned that the walls of the packet tube (50) are domed inwards.

26. An apparatus according to claim 24, characterised in that the matrix (116) consists of an upper part (117) and a lower part (118) arranged with spacing therefrom.

27. An apparatus according to claim 23, characterised in that the packet tube can be withdrawn from the winding mandrel (51) and drawn through the matrix (116) by a gripper (101) arranged reciprocatingly in relation to the winding turret (52).

28. An apparatus according to claim 27, characterised in that the gripper (101) is equipped with at least two clamping members (104, 105; 106) for grasping the longitudinal end flaps (40, 41) of the packet tube (50).

29. An apparatus according to claim 28, characterised in that the clamping members (104, 105; 106) consist of two outer jaws (104, 105) grasping the packet tube (50) on the outside and at least one inner jaw (106) which enters the packet tube (50) and presses it against the outer jaws (104, 105).

30. An apparatus according to claim 29, characterised in that the inner jaw (106) is pressable with clamping faces (110) against the outer jaws (104, 105) by rotation, of a rotary rod (107) actuated by a crank gearing.

31. An apparatus according to claim 28, characterised in that the clamping members (104, 105; 106) are loaded in the clamping position by a tension spring (114) acting on a pivot piece (111), and in that at the end points of the path of movement of the gripper (101) at the taking over of the packet tube (50) from the winding mandrel (51) and at the release thereof, the clamping members (104, 105; 106) are movable into the open position against the spring loading by the running of the pivot piece (111) up on to end stops (113, 121).

32. An apparatus according to claim 23, characterised in that the packet tube (50) withdrawn from the winding mandrel (51) can be set upon a retainer with upper guide (119) and lower guide (120) close to the folding turret (53), and fed to the folding turret (53).

33. An apparatus according to claim 32, characterised in that the packet tube (50) can be grasped by drive members (122) arranged on both sides of the folding turret (53) and introduced into a pocket (130) of the folding turret (53).

34. An apparatus according to claim 33, characterised in that the drive members (122) can be applied to the packet tube (50) especially in the region of the longitudinal end flaps (40, 41), and in that the packet tube (50) is fixable on the drive members (122) by vacuum-charged suction bores (124).

35. An apparatus according to claim 34, characterised in that the folding turret (53) consists of a turret disc (129) moved in cadence, on the external periphery of which there are provided pockets (130) of U-shaped cross-section which are open to the exterior and to the sides.

36. An apparatus according to claim 35, characterised in that the pockets (130) are closable on the radially outer side by outer lids (131) which can be pivoted into and out of position.

37. An apparatus according to claim 36, characterised in that the outer lids (131) are moved into the closed position during the execution of folding and closure operations on the end flaps (40 to 43) protruding at both ends.

38. An apparatus according to claim 37, characterised in that in a first folding station (139) of the folding turret (53) the inner longitudinal end flap (40) is foldable into the end face against the packet content.

39. An apparatus according to claim 38, characterised in that the inner longitudinal end flap (40) can be folded over by a folder (140) arranged on the side of the inner longitudinal end flap (40) and pivotable from the exterior against the latter.

40. An apparatus according to claim 39, characterised in that in a second folding station (153) of the folding turret (53) the lateral end flaps (42, 43) and the outer longitudinal end flap (41) are foldable in common.

41. An apparatus according to claim 40, characterised in that the lateral end flaps (42, 43) are foldable by pivotable lateral fold-in members (155, 156) which are foldable from the exterior against the lateral end flaps (42, 43) in such a way that an edge (157) of the lateral fold-in members (155, 156) abuts in the region of a diagonal fold line (46) of the lateral end flaps (42, 43) on these and the lateral fold-in members (155, 156) come between the forming triangular lappets (47, 48).

42. An apparatus according to claim 41, characterised in that the outer longitudinal end flap (41) is foldable by a pivotable guide plate (158) applied to the outside of the longitudinal end flap.

43. An apparatus according to claim 42, characterised in that a support plate (154) rests on the folded inner longitudinal end flap (40).

44. An apparatus according to claim 40, characterised in that the folding tools of the folding stations (139, 153) are applicable in common to the folding turret (53) and pivotable away from it during its further movement.

45. An apparatus according to claim 44, characterised in that the folding tools of the folding stations (139 and 153) are fitted on a main arm (144) which is drivable in pivoting by a common drive comprising a crank arm 145 and an angle arm 147.

46. An apparatus according to claim 44, characterised in that the folding tools of the folding stations (139 and 153) are movable by a central drive.

47. An apparatus according to claim 46, characterised in that the second folding station (153) is followed by a closer station (162) having a presser plate (163) which is pressable against the folded end faces of the packet.

48. An apparatus according to claim 47, characterised in that the presser plate (163) is connected to the central drive for the folding tools of the folding stations (139, 153).

49. An apparatus according to claim 48, characterised in that the closer station (162) is followed by an activation station (183) in which the surfaces of the folded end flaps to be connected with one another are activatable by a hot air slot nozzle (184) entering the formed wedge-shaped gap.

50. An apparatus according to claim 49, characterised in that the activation station (183) is followed by a presser station (185) and a finisher station (187) in which the activated lateral end flaps (42, 43) are pressable into the closure position by a presser roller (186) and a press plate (188).

* * * * *